US007454934B2

(12) United States Patent
Lin

(10) Patent No.: US 7,454,934 B2
(45) Date of Patent: Nov. 25, 2008

(54) RESETTABLE TUMBLER LOCK

(76) Inventor: Sheng-Ting Lin, No. 5, Li-Hsing La. Chung-Chang Rd., Hsin-Chuang City, Taipei Hsien (TW)

( * ) Notice: Subject to any disclaimer, the term of this patent is extended or adjusted under 35 U.S.C. 154(b) by 192 days.

(21) Appl. No.: 11/356,631

(22) Filed: Feb. 16, 2006

(65) Prior Publication Data

US 2007/0186601 A1 Aug. 16, 2007

(51) Int. Cl.
*E05B 27/00* (2006.01)
*E05B 29/00* (2006.01)

(52) U.S. Cl. ..... 70/491; 70/351; 70/378; 70/404; 70/DIG. 37

(58) Field of Classification Search ..... 70/350–351, 70/375–376, 378, 403–404, 419, 453, 454, 70/491, 493, DIG. 37
See application file for complete search history.

(56) References Cited

U.S. PATENT DOCUMENTS 3,648,492 A * 3/1972 Walters et al. ..... 70/491
3,903,720 A * 9/1975 Scherbing ..... 70/491
4,235,086 A * 11/1980 Genakis ..... 70/378
4,621,510 A * 11/1986 Scherbing ..... 70/491
4,899,565 A * 2/1990 Steinbach ..... 70/491
5,018,376 A * 5/1991 Lee ..... 70/491
5,419,168 A * 5/1995 Field ..... 70/378
5,640,865 A * 6/1997 Widen ..... 70/378
6,357,271 B1 * 3/2002 Hsu ..... 70/491
6,550,299 B1 * 4/2003 Lin ..... 70/491
7,234,330 B2 * 6/2007 Tseng ..... 70/491

* cited by examiner

*Primary Examiner*—Patricia L Engle
*Assistant Examiner*—Christopher Boswell
(74) *Attorney, Agent, or Firm*—Ladas & Parry LLP

(57) ABSTRACT

A resettable tumbler lock includes: a lock housing; a sleeve mounted rotatably in the lock housing and formed with a plurality of tumbler bores; a cylindrical latch-connecting part mounted rotatably in the lock housing and formed with a plurality of tumbler holes and a plurality of blind holes; and a plurality of spring-biased tumbler units. The sleeve is rotatable relative to the latch-connecting part between first and second angular positions. At least one of the tumbler bores in the sleeve has an axial projection that does not coincide with that of an aligned one of the tumbler holes in the latch-connecting part when the sleeve is disposed at a predetermined position between the first and second angular positions.

12 Claims, 7 Drawing Sheets

RESETTABLE TUMBLER LOCK

BACKGROUND OF THE INVENTION

1. Field of the Invention

This invention relates to a resettable tumbler lock, more particularly to a resettable tumbler lock having tumbler holes with cross sections that differ from each other in at least one of the group consisting of shape, size, and orientation.

2. Description of the Related Art

U.S. Pat. No. 6,550,299 discloses a conventional resettable tumbler lock that includes a housing, a first sleeve mounted rotatably in the housing and formed with a plurality of axially extending holes and a first locking hole, a second sleeve mounted in and secured to the housing and formed with a plurality of axially extending holes and a second locking hole, a cylindrical latch-connecting part disposed between and in end-to-end contact with the first and second sleeves and formed with a plurality of axially extending holes and a middle locking hole, and a plurality of spring-biased tumbler units including first tumbler pins disposed movably and respectively in the holes in the first sleeve, middle tumbler pins disposed movably and respectively in the holes in the latch-connecting part, second tumbler pins disposed movably and respectively in the holes in the second sleeve, a first locking pin disposed movably in the first locking hole, a second locking pin disposed movably in the second locking hole, and a middle locking pin disposed movably in the middle locking hole. The latch-connecting part is provided with a latch for locking purposes, and is further formed with a plurality of blind bores. Each of the tumbler units further includes a plurality of spring-biased tumbler pads that are disposed movably in each of the blind bores and optionally and selectively in a respective one of the holes in the first sleeve. A plurality of reset keys, each of which is formed with different depths of notches, are provided for the resettable tumbler lock so that the total axial length of each of the tumbler units (i.e., the total axial length of the first tumbler pin, the middle tumbler pin, the second tumbler pin, and the tumbler pad(s) which is (are) present in the respective hole in the first sleeve) in a respective one of the holes in the first sleeve, a respective one of the holes in the latch-connecting part, and a respective one of the holes in the second sleeve can be changed in accordance with a corresponding one of the depths of the notches of a respective one of the reset keys and so that the resettable tumbler lock can be locked and unlocked through an operating key corresponding to the respective reset key. To change the total axial length of any of the tumbler units, the first sleeve is first rotated relative to the latch-connecting part using a current reset key from a normal angular position to a resettable angular position, in which the holes in the first sleeve are aligned axially and respectively with the blind bores in the latch-connecting part, followed by replacing the current reset key with a desired reset key so that a predetermined number of the tumbler pads can be moved into or out of a respective hole in the first sleeve in accordance with the depths of the notches of the desired reset key. The desired reset key is then rotated from the resettable angular position to the normal angular position, and is subsequently removed therefrom. As such, the resettable tumbler lock can be locked and unlocked by co-rotating the latch-connecting part relative to the second sleeve using a corresponding operating key. The middle locking pin in the middle locking hole crosses a locking plane defined by an interface between ends of the latch-connecting part and the second sleeve when a current one of the reset keys is inserted into a keyhole in the resettable tumbler lock, thereby preventing rotation of the latch-connecting part relative to the second sleeve and permitting rotation of the first sleeve relative to the latch-connecting part. An interface between ends of the middle locking pin and the second locking pin and an interface between ends of each pair of the middle tumbler pin and the second tumbler pin lie on the locking plane when the corresponding operating key is inserted into the keyhole, thereby permitting co-rotation of the first sleeve and the latch-connecting part.

The shapes of the holes in the first sleeve are identical, are circular, and are the same as those of the holes in the latch-connecting part and the second sleeve and those of the blind bores in the latch-connecting part. The shape and size of each of the first and second tumbler pins, the middle tumbler pins, and the tumbler pads conform to those of the holes in the first and second sleeves and the latch-connecting part.

The conventional resettable tumbler lock is disadvantageous in that since the shapes of the holes in the first sleeve are circular and are identical to those of the blind bores in the latch-connecting part, an innermost tumbler pad in the respective hole in the first sleeve tends to be undesirably moved across the interface between the first sleeve and the latch-connecting part and to extend into an aligned hole in the latch-connecting part, which is aligned with the hole in the first sleeve, by the reset key during rotation of the first sleeve from the resettable angular position to the normal angular position, which results in a deadlock situation in which the first sleeve cannot be further rotated to the normal angular position by the reset key and the reset key cannot be removed from the keyhole. Moreover, since small clearances are present between moving parts, i.e., the first sleeve and the latch-connecting part and the middle tumbler pin and an adjacent one of the tumbler pads, of the resettable tumbler lock, the innermost tumbler pad in the respective hole in the first sleeve is likely to be moved across the interface between the first sleeve and the latch-connecting part and be extended into the axially aligned hole in the latch-connecting part by the reset key during rotation of the first sleeve from the second angular position to the first angular position.

SUMMARY OF THE INVENTION

Therefore, it is an object of the present invention to provide a resettable tumbler lock that is capable of overcoming the aforementioned drawback of the prior art.

Accordingly, a resettable tumbler lock of this invention comprises: a lock housing; a sleeve mounted coaxially and rotatably in the lock housing and formed with a plurality of tumbler bores; a cylindrical latch-connecting part mounted coaxially and rotatably in the lock housing and in end-to-end contact with the sleeve, the latch-connecting part being formed with a plurality of circumferentially disposed tumbler holes and a plurality of circumferentially disposed blind holes that are angularly displaced with the tumbler holes; and a plurality of spring-biased tumbler units, each of which is disposed movably in a respective one of the tumbler bores, a respective one of the tumbler holes, and a respective one of the blind holes. The sleeve is operable to rotate relative to the latch-connecting part between a first angular position, in which the tumbler bores in the sleeve are aligned axially and respectively with the tumbler holes in the latch-connecting part, and a second angular position, in which the tumbler bores in the sleeve are aligned axially and respectively with the blind holes in the latch-connecting part. Each of the tumbler bores in the sleeve has an axial projection that coincides with that of the axially aligned one of the tumbler holes in the latch-connecting part when the sleeve is disposed at the first angular position, and that coincides with that of the axially aligned one of the blind holes in the latch-connecting part when the sleeve is disposed at the second angular position. At least one of the tumbler bores in the sleeve is aligned axially with one of the tumbler holes in the latch-connecting part when the sleeve is rotated relative to the latch-connecting part to a predetermined position between the first and second angular positions. The axial projection of said one of the tumbler bores in the sleeve does not coincide with that of the aligned one of the tumbler holes in the latch-connecting part when the sleeve is disposed at the predetermined position between the first and second angular positions.

BRIEF DESCRIPTION OF THE DRAWINGS

In drawings which illustrate an embodiment of the invention.

DETAILED DESCRIPTION OF THE PREFERRED EMBODIMENT

Figure 1:
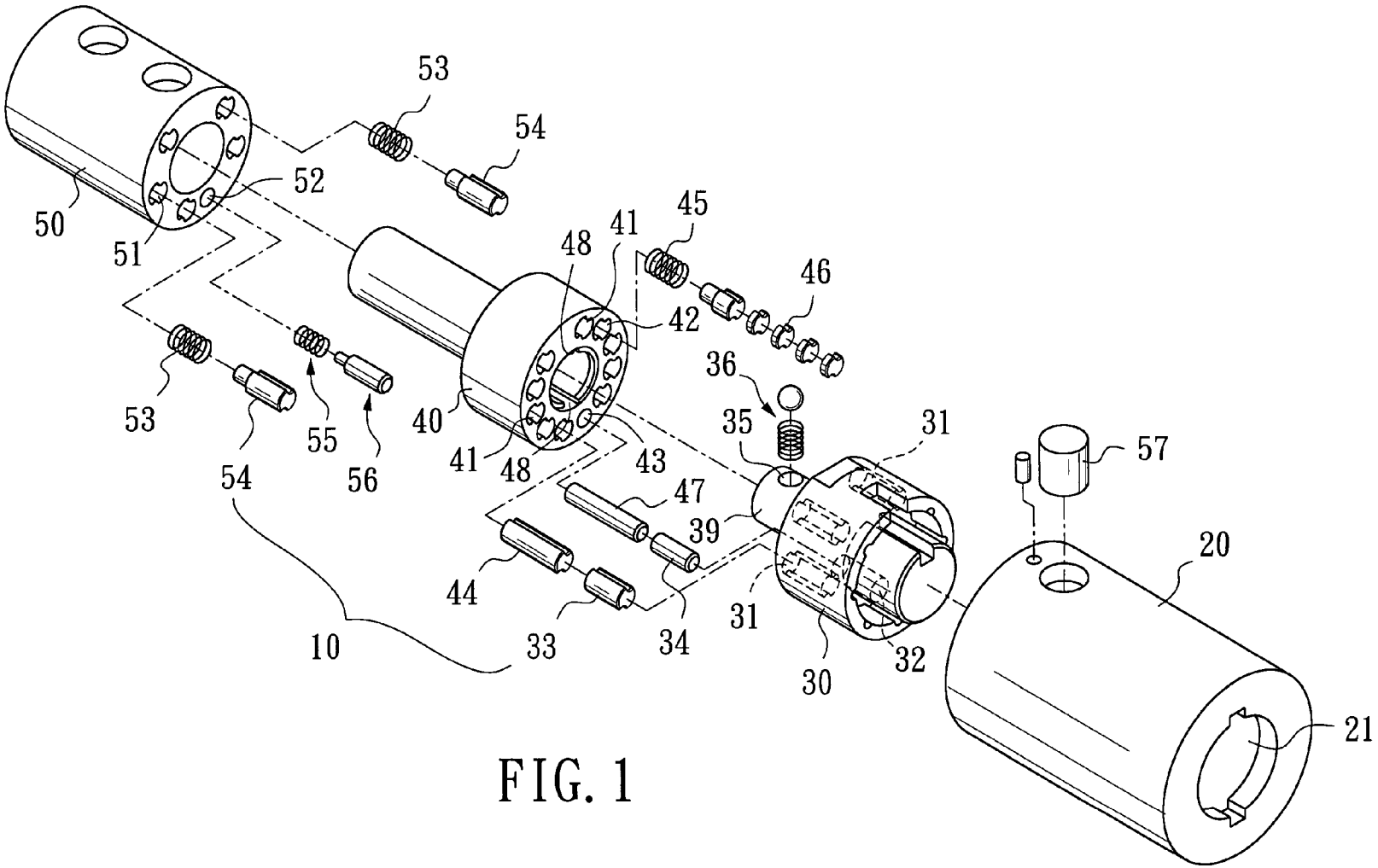
FIG. 1 is an exploded perspective view of the preferred embodiment of a resettable tumbler lock according to this invention.
Figure 4:
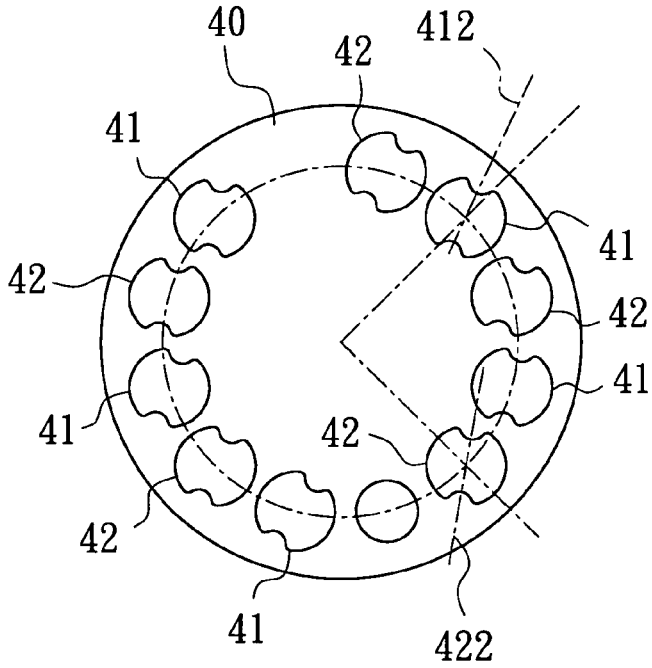
FIG. 4 is a schematic view to illustrate orientations of symmetric axes of tumbler holes in a latch-connecting part of the preferred embodiment.
Figure 5:
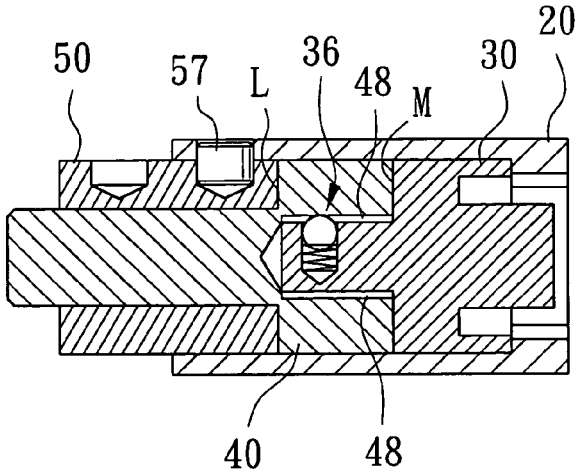
FIG. 5 is an assembled sectional view of the preferred embodiment.
Figure 7:
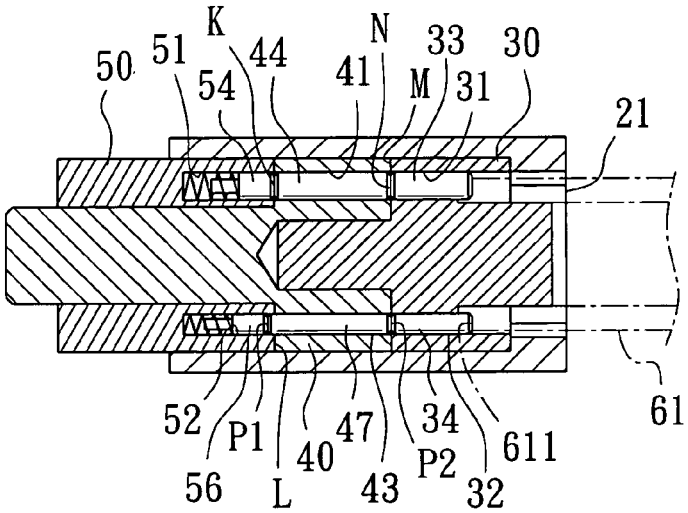
FIG. 7 is a sectional view taken from lines VII-VII in FIG. 6.
Figure 6:
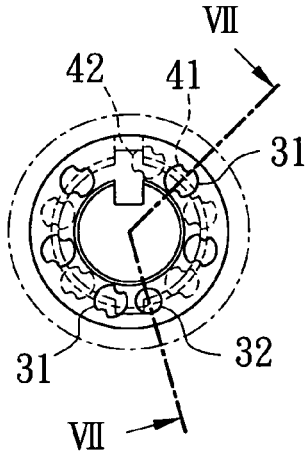
FIG. 6 is a schematic view to illustrate a state in which a reset key is inserted into a keyhole in the preferred embodiment and in which the first sleeve of the preferred embodiment is disposed at a first angular position.
Figure 11:
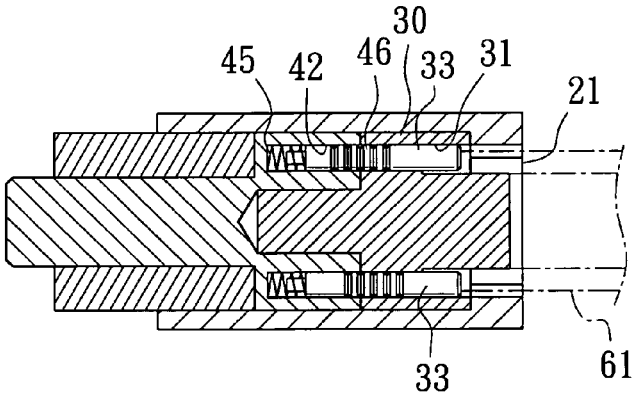
FIG. 11 is a sectional view taken from lines XI-XI in FIG. 10.
Figure 10:
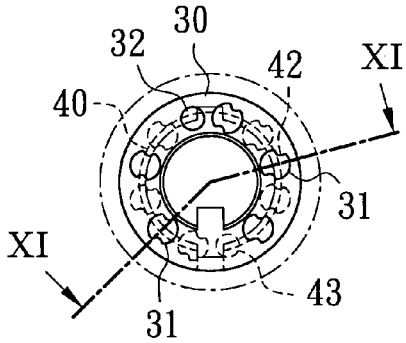
FIG. 10 is a schematic view to illustrate yet another state in which another reset key is inserted into the keyhole in the preferred embodiment and in which the first sleeve of the preferred embodiment is disposed at a second angular position.
Figure 16:
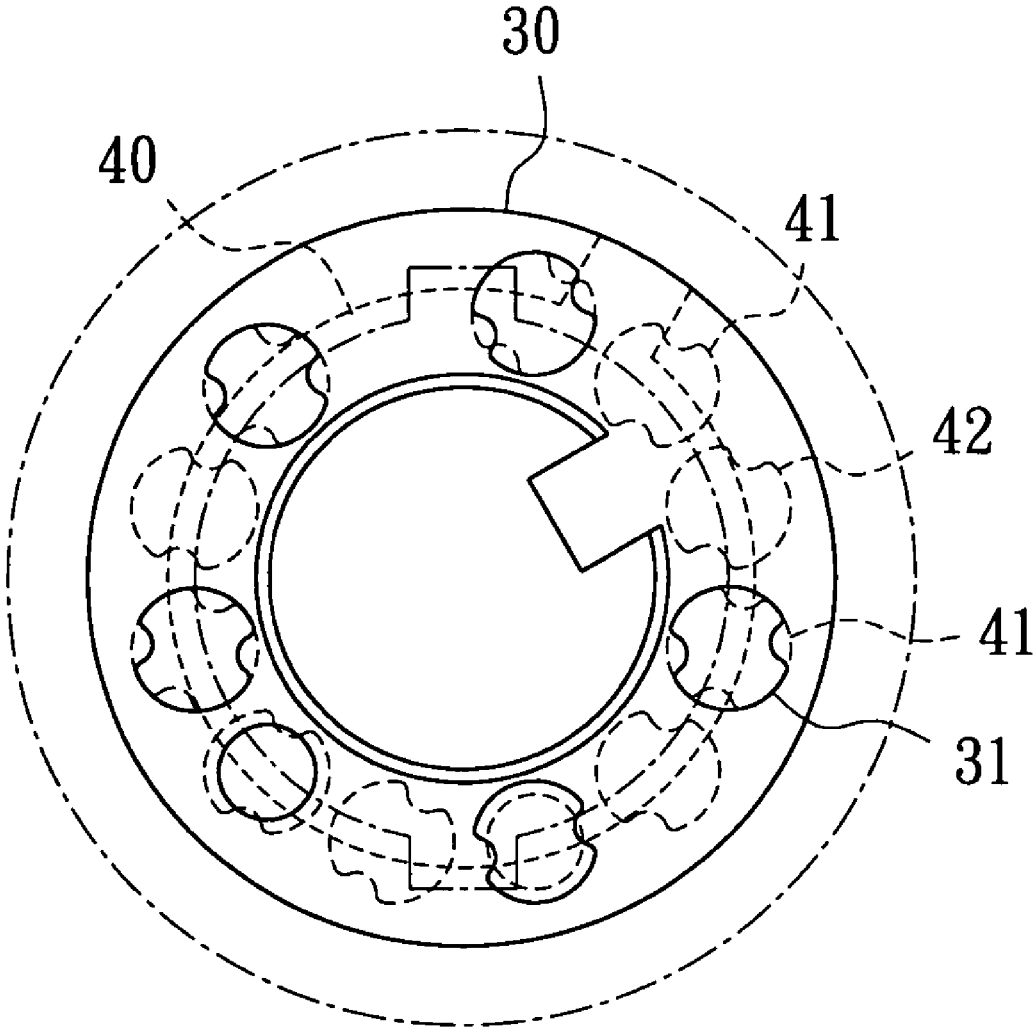
FIG. 16 is a schematic view to illustrate yet another state in which the first sleeve is rotated to a predetermined angular position between the first and second angular position.

FIGS. 1 and 5 illustrate the preferred embodiment of a resettable tumbler lock according to this invention. The resettable tumbler lock includes: a cylindrical lock housing 20 defining a keyhole 21; a first sleeve 30 mounted coaxially and rotatably in the lock housing 20 and formed with a plurality of tumbler bores 31 (see FIG. 3); a cylindrical latch-connecting part 40 mounted coaxially and rotatably in the lock housing 20 and in end-to-end contact with the first sleeve 30, the latch-connecting part 40 being formed with a plurality of circumferentially disposed tumbler holes 41 and a plurality of circumferentially disposed blind holes 42 (see FIG. 4) that are angularly displaced with the tumbler holes 41; and a plurality of spring-biased tumbler units 10, each of which is disposed movably in a respective one of the tumbler bores 31, a respective one of the tumbler holes 41, and a respective one of the blind holes 42. The first sleeve 30 is operable using a reset key 61 (see FIG. 2) or an operating key 62 to rotate relative to the latch-connecting part 40 between a first angular position (see FIGS. 6 and 7), in which the tumbler bores 31 in the first sleeve 30 are aligned axially and respectively with the tumbler holes 41 in the latch-connecting part 40, and a second angular position (see FIGS. 10 and 11), in which the tumbler bores 31 in the first sleeve 30 are aligned axially and respectively with the blind holes 42 in the latch-connecting part 40. Each of the tumbler bores 31 in the first sleeve 30 has an axial projection coincides with that of the axially aligned one of the tumbler holes 41 in the latch-connecting part 40 (see FIG. 6) when the first sleeve 30 is disposed at the first angular position, and that coincides with that of the axially aligned one of the blind holes 42 in the latch-connecting part 40 (see FIG. 10) when the first sleeve 30 is disposed at the second angular position. At least one of the tumbler bores 31 in the first sleeve 30 is aligned axially with one of the tumbler holes 41 in the latch-connecting part 40 when the first sleeve 30 is rotated relative to the latch-connecting part 40 to a predetermined position (see FIG. 16) between the first and second angular positions. The axial projection of said one of the tumbler bores 31 in the first sleeve 30 does not coincide with that of the aligned one of the tumbler holes 41 in the latch-connecting part 40 when the first sleeve 30 is disposed at the predetermined position between the first and second angular positions.

In this embodiment, to achieve the function that the axial projection of said one of the tumbler bores 31 in the first sleeve 30 does not coincide with that of the aligned one of the tumbler holes 41 in the latch-connecting part 40 when the first sleeve 30 is disposed at the predetermined position between the first and second angular positions, the tumbler bores 31 in the first sleeve 30 can be configured such that they differ from each other in at least one of the group consisting of shape, size, and orientation.

Figure 3:
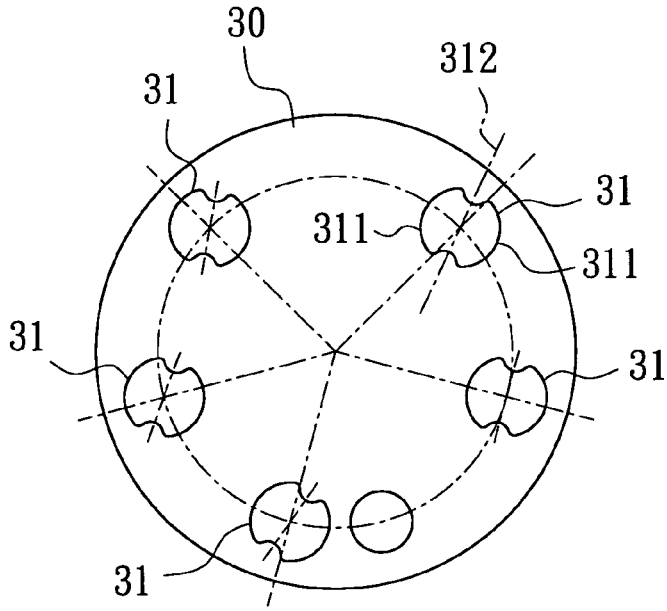
FIG. 3 is a schematic view to illustrate orientations of symmetric axes of tumbler bores in a first sleeve of the preferred embodiment.

In this embodiment, each of the tumbler bores 31 in the first sleeve 30 is the same as that of each of the tumbler holes 41 in the latch-connecting part 40, and is non-circular (see FIGS. 1 and 3). Moreover, each of the tumbler bores 31 in the first sleeve 30 has symmetrical portions 311 and defines a symmetric axis 312 (see FIG. 3). The symmetric axes 312 of the tumbler bores 31 differ from each other in orientation. Similarly, each of the tumbler holes 41 in the latch-connecting part 40 defines a symmetric axis 412 (see FIG. 4) that has the same orientation with that of the corresponding one of the tumbler bores 31 in the first sleeve 30, and each of the blind holes 42 in the latch-connecting part 40 defines a symmetric axis 422

(see FIG. 4) that has the same orientation with that of the corresponding one of the tumbler bores 31 in the first sleeve 30.

Figure 9:
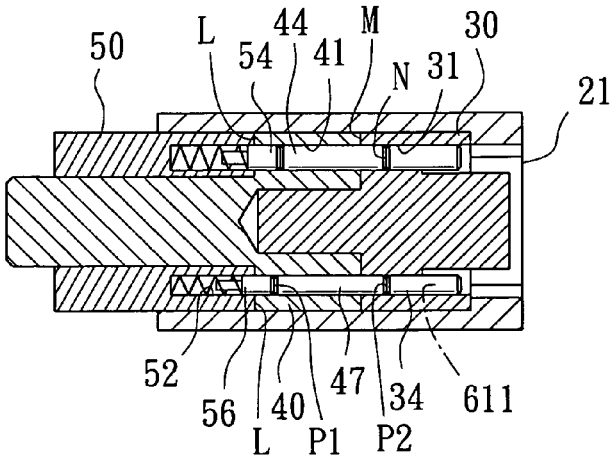
FIG. 9 is a sectional view taken from lines IX-IX in FIG. 8.
Figure 8:
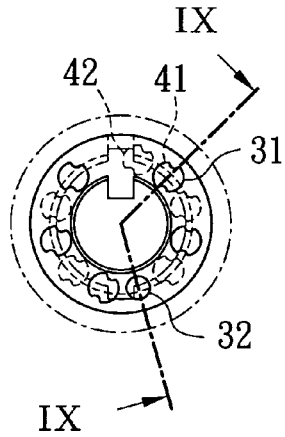
FIG. 8 is a schematic view to illustrate yet another state in which the reset key is removed from the keyhole in the preferred embodiment and in which the first sleeve of the preferred embodiment is disposed at the first angular position.
Figure 15:
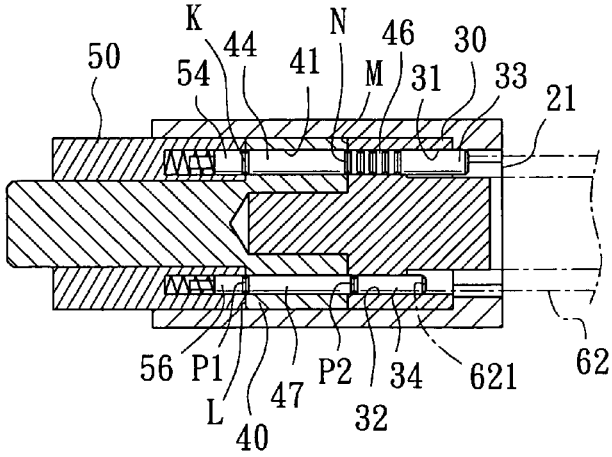
FIG. 15 is a sectional view taken from lines XV-XV in FIG. 14.

The first sleeve 30 and the latch-connecting part 40 has an interface cooperatively define a resetting plane (M) at the interface therebetween (see FIG. 5). Referring back to FIG. 1, each of the tumbler units 10 includes a first tumbler pin 33 disposed movably in a respective one of the tumbler bores 31 in the first sleeve 30, a middle tumbler pin 44 disposed movably in a respective one of the tumbler holes 41 in the latch-connecting part 40, and a plurality of tumbler pads 46 disposed movably and selectively in the blind holes 42 and the tumbler bores 31 such that at least one of the tumbler bores 31 receives at least one of the tumbler pads 46 of the respective one of the tumbler units 10 therein (see FIGS. 11 and 15). Said at least one of the tumbler pads 46 in said at least one of the tumbler bores 31 is in end-to-end contact with the middle tumbler pin 44 in the respective one of the tumbler holes 41 so as to define a first interface (N) therebetween (see FIG. 15). The first tumbler pin 33 in each of the remainder of the first tumbler bores 31 is in end-to-end contact with the middle tumbler pin 44 in the respective one of the remainder of the tumbler holes 41 so as to define another first interface (N) therebetween (see FIG. 7). The tumbler units 10 are operable to move axially using the reset key 61 (see FIG. 7) from a first axial position (see FIGS. 8 and 9), in which at least one of the first interfaces (N) is axially spaced apart from there setting plane (M), to a second axial position (see FIGS. 6 and 7), in which the first interfaces (N) lie on the resetting plane (M), thereby permitting rotation of the first sleeve 30 relative to the latch-connecting part 40.

The resettable tumbler lock further includes a second sleeve 50 that is disposed opposite to the first sleeve 30 and that is in end-to-end contact with the latch-connecting part 40 so as to define a locking plane (L) at an interface therebetween (see FIG. 5). The first sleeve 30 is further formed with a first locking bore 32 (see FIG. 1). The latch-connecting part 40 is further formed with a middle locking bore 43. The second sleeve 50 is formed with a plurality of circumferentially disposed blind bores 51 and a second locking bore 52. Each of the tumbler units 10 further includes a second tumbler pin 54 disposed movably in a respective one of the blind bores 51 in the second sleeve 50. The resettable tumbler lock further includes a first locking pin 34 disposed movably in the first locking bore 32, a middle locking pin 47 disposed movably in the middle locking bore 43, and a second locking pin 56 disposed movably in the second locking bore 52. The first sleeve 30 and the latch-connecting part 40 are operable to co-rotate relative to the second sleeve 50 so as to permit rotation of the latch-connecting part 40 between locked and unlocked positions using the operating key 62. The blind bores 52 in the second sleeve 50 are aligned axially and respectively with the tumbler bores 31, the axial projection of each of the blind bores 52 coinciding with that of the respective one of the tumbler bores 31, and the first, second, and third locking bores 34, 43, 56 being aligned axially when the first sleeve 30 is disposed at the first angular position (see FIG. 7). The second tumbler pin 54 of each of the tumbler units 10 is in end-to-end contact with the middle tumbler pin 44 of the respective one of the tumbler units 10 so as to define a second interface (K) therebetween (see FIGS. 7 and 15). The second locking pin 56 is in end-to-end contact with the middle locking pin 47 so as to define a first locking interface (P1) therebetween (see FIGS. 7 and 15). The middle locking pin 47 is in end-to-end contact with the first locking pin 34 so as to define a second locking interface (P2) therebetween (see FIGS. 7 and 15). The first locking interface (P1) is disposed within the second locking bore 52, and the second locking interface (P2) lies on the resetting plane (M) when the tumbler units 10 are moved to the second axial position (see FIG. 7) using the reset key 61, thereby preventing rotation of the latch-connecting part 40 relative to the second sleeve 50 when the first sleeve 30 is rotated relative to the latch-connecting part 40. The tumbler units 10 are further operable to move axially using the operating key 62 from the first axial position to a third axial position (see FIG. 15), in which the second interfaces (K) and the first locking interface (P1) lie on the locking plane (L) and in which the second locking interface (P2) is disposed within the first locking bore 32, thereby permitting co-rotation of the first sleeve 30 and the latch-connecting part 40 relative to the second sleeve 50. Note that the tumbler units 10 are moved from the first axial position to the second axial position using the reset key 61 as described above.

The resettable tumbler lock further includes a plurality of first urging members 45 that are respectively disposed in the blind holes 42 in the latch-connecting part 40 for urging the tumbler pads 46, a plurality of second urging members 53 that are respectively disposed in the blind bores 51 in the second sleeve 50 for urging the second tumbler pins 54, and a third urging member 55 that is disposed in the second locking bore 52 for urging the second locking pin 56.

Each of the first and second tumbler pins 33, 54, the middle tumbler pins 44, and the tumbler pads 46 has a cross-section conforming to the shape of the tumbler bores 31 in the first sleeve 30. The first and second locking bores 32, 52 and the middle locking bore 43 are circular in shape.

Referring back to FIG. 1, a fastening pin 57 extends through a hole in the lock housing 20 and into a hole in the second sleeve 50 so as to secure the second sleeve 50 to the lock housing 20.

Referring back to FIGS. 1 and 5, the latch-connecting part 40 is formed with a cylindrical shaft 49 that extends axially and that is reduced in cross-section therefrom. The second sleeve 50 is sleeved rotatably on the shaft 49 of the latch-connecting part 40. A latch (not shown) is connected to an end of the shaft 49 of the latch-connecting part 40 that extends through the second sleeve 50 for engaging a door frame (not shown) when the first sleeve 30 is rotated to the second angular position. The first sleeve 30 is formed on and extends radially from a cylindrical rod 39 that has an inner end formed with a retaining hole 35 and extending into the latch-connecting part 40. The latch-connecting part 40 is formed with upper and lower axially extending retaining grooves 48 that are diametrically disposed. A spring-biased ball 36 is retained in the retaining hole 35- and protrudes into the upper retaining groove 48 when the first sleeve 30 is disposed at the first angular position, and protrudes into the lower retaining groove 48 when the first sleeve 30 is disposed at the second angular position.

Figure 2:
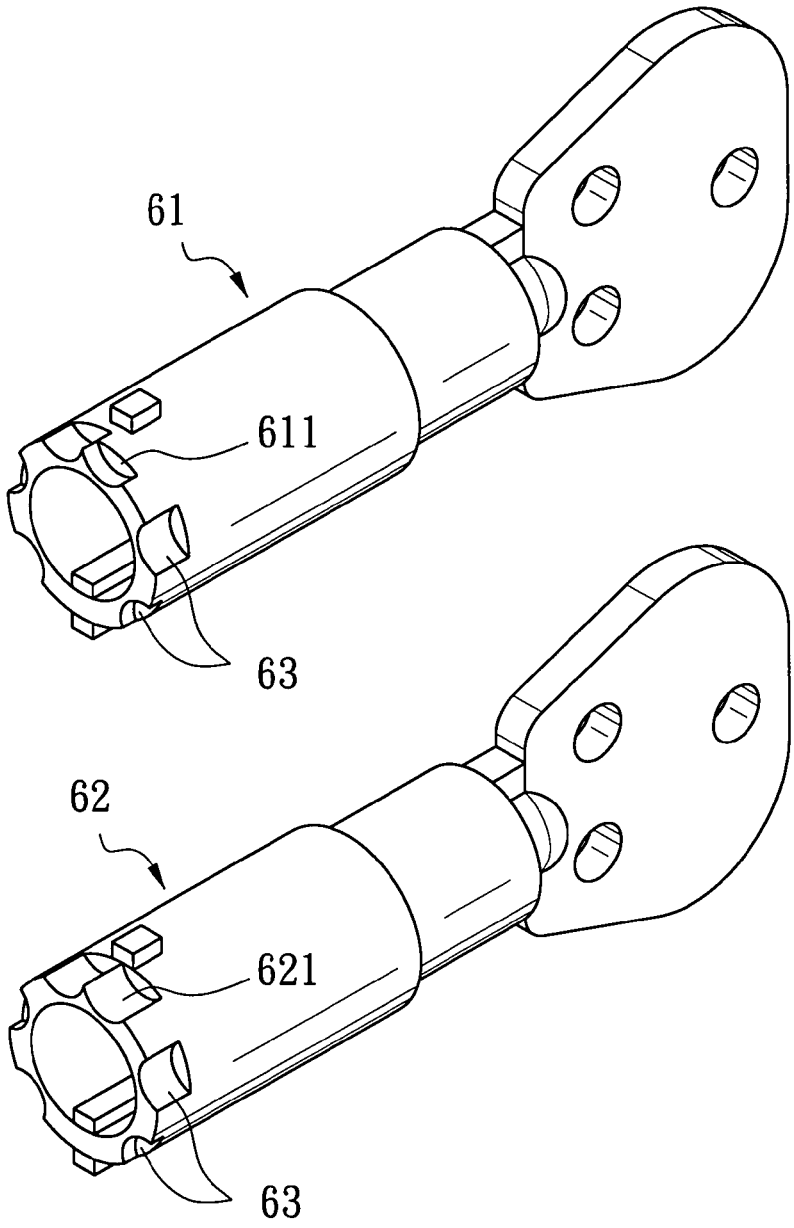
FIG. 2 is a perspective view of a reset key and an operating key for the preferred embodiment.

Referring to FIG. 2, each of the reset key 61 and the operating key 62 is formed with a plurality of indentations 63. The indentations 63 of the reset key 61 are respectively the same as the indentations 63 of the operating key 62. The number of the tumbler pads 46 that can be received in each of the first tumbler bores 31 for setting of a selected operating key 62 depends on the depth of a respective indentation 63 of the reset key 61. The reset key 61 is further formed with a locking indentation 611 for moving the first, middle, and second locking pins 34, 47, 56 to the position shown in FIG. 7, where the first locking interface (P1) is disposed within the second locking bore 52 and where the second locking interface (P2) lies on the resetting plane (M). The operating key 62 is further formed with a locking indentation 621 for moving the first, middle, and second locking pins 34, 47, 56 to the position shown in FIG. 15, where the first locking interface (P1) lies on the locking plane (L) and where the second locking interface (P2) is disposed within the first locking bore 32.

Figure 13:
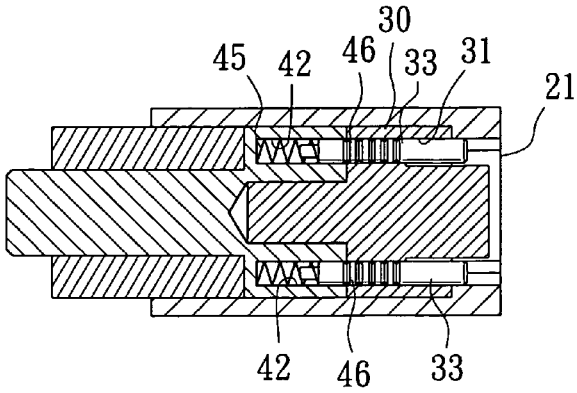
FIG. 13 is a sectional view taken from lines XIII-XIII in FIG. 12.
Figure 12:
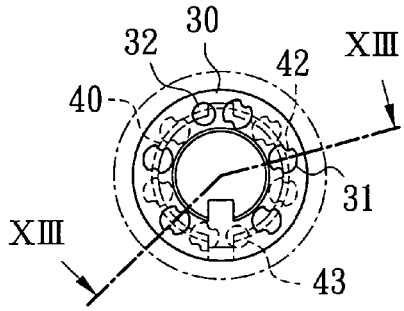
FIG. 12 is a schematic view to illustrate yet another state in which the reset key is removed from the keyhole in the preferred embodiment and in which the first sleeve of the preferred embodiment is disposed at the second angular position.
Figure 14:
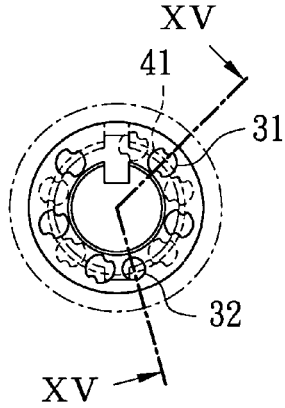
FIG. 14 is a schematic view to illustrate yet another state in which an operating key is inserted into the keyhole in the preferred embodiment and in which the first sleeve of the preferred embodiment is disposed at the first angular position.

In operation, when it is desired to change the setting of the resettable tumbler lock from a first operating key 62 to a second operating key 62, the original reset key 61 is inserted into the keyhole 21 to move the tumbler units 10 from the first axial position (see FIG. 8) to the second axial position (see FIG. 7), is then rotated from the first angular position to the second angular position, and is subsequently removed from the keyhole 21 (see FIGS. 12 and 13). The tumbler pads 46 in each of the blind holes 42 are moved into the respective first tumbler bore 31 by the urging action of the respective first urging member 45 when the original reset key 61 is removed. The reset key 61 corresponding to the selected operating key 62 is then inserted into the keyhole 21 (see FIG. 11), and is rotated from the second angular position to the first angular position, thereby resetting the resettable tumbler lock and allowing only the corresponding operating key 62 to lock and unlock the resettable tumbler lock (see FIGS. 14 and 15).

By making the first tumbler bores 31 in the first sleeve 30 of the resettable tumbler lock of this invention have different orientations in the symmetrical axes 312 and have shapes respectively the same as those of the middle tumbler holes 41 and the blind holes 42 in the latch-connecting part 40, and the second tumbler bores 51 in the second sleeve 50, the aforesaid deadlock drawback associated with the prior art can be eliminated.

With the invention thus explained, it is apparent that various modifications and variations can be made without departing from the spirit of the present invention. It is therefore intended that the invention be limited only as recited in the appended claims.

What is claimed is:

1. A resettable tumbler lock comprising:

a lock housing;

a first sleeve mounted coaxially and rotatably in said lock housing and formed with a plurality of tumbler bores, each having a longitudinal axis and a non-circular cross-section perpendicular to said longitudinal axis;

a cylindrical latch-connecting part mounted coaxially and rotatably in said lock housing and in end-to-end contact with said first sleeve, said latch-connecting part being formed with a plurality of circumferentially disposed tumbler holes and a plurality of circumferentially disposed blind holes that are angularly displaced with said tumbler holes; and a plurality of spring-biased tumbler units, each of which is disposed movably in a respective one of said tumbler bores, a respective one of said tumbler holes, and a respective one of said blind holes; wherein said first sleeve is operable to rotate relative to said latch-connecting part between a first angular position, in which said tumbler bores in said first sleeve are aligned axially and respectively with said tumbler holes in said latch-connecting part, and a second angular position, in which said tumbler bores in said first sleeve are aligned axially and respectively with said blind holes in said latch-connecting part;

wherein each of said tumbler bores in said first sleeve has an axial projection that coincides with that of the axially aligned one of said tumbler holes in said latch-connecting part when said first sleeve is disposed at said first angular position, and that coincides with that of the axially aligned one of said blind holes in said latch-connecting part when said first sleeve is disposed at said second angular position;

wherein at least one of said tumbler bores in said first sleeve is aligned axially with one of said tumbler holes in said latch-connecting part when said first sleeve is rotated relative to said latch-connecting part to a predetermined position between said first and second angular positions; and wherein the axial projection of said one of said tumbler bores in said first sleeve does not coincide with that of the aligned one of said tumbler holes in said latch-connecting part when said first sleeve is disposed at the predetermined position between said first and second angular positions so as to prevent deadlock from occurring on said resettable tumbler lock.

2. The resettable tumbler lock of claim 1, wherein each of said tumbler bores has symmetrical portions and defines a symmetric axis, and said symmetric axes of said tumbler bores differ from each other in orientation.

3. The resettable tumbler lock of claim 2, wherein said first sleeve and said latch-connecting part have an interface and cooperatively define a resetting plane at the interface therebetween, each of said tumbler units including a first tumbler pin disposed movably in a respective one of said tumbler bores in said first sleeve, a middle tumbler pin disposed movably in a respective one of said tumbler holes in said latch-connecting part, and a plurality of tumbler pads disposed movably and selectively in said blind holes and said tumbler bores such that at least one of said tumbler bores receives at least one of said tumbler pads of the respective one of said tumbler units therein, said at least one of said tumbler pads in said at least one of said tumbler bores being in end-to-end contact with said middle tumbler pin in the respective one of said tumbler holes so as to define a first interface therebetween, said first tumbler pin in each of the remainder of said first tumbler bores being in end-to-end contact with said middle tumbler pin in the respective one of the remainder of said tumbler holes so as to define another first interface therebetween, said tumbler units being operable to move axially from a first axial position, in which at least one of said first interfaces is axially spaced apart from said resetting plane, to a second axial position, in which said first interfaces lie on said resetting plane, thereby permitting rotation of said first sleeve relative to said latch-connecting part.

4. The resettable tumbler lock of claim 3, further comprising a second sleeve that is disposed opposite to said first sleeve and that is in end-to-end contact with said latch-connecting part so as to define a locking plane at an interface therebetween, said first sleeve being further formed with a first locking bore, said latch-connecting part being further formed with a middle locking bore, said second sleeve being formed with a plurality of circumferentially disposed blind bores and a second locking bore, each of said tumbler units further including a second tumbler pin disposed movably in a respective one of said blind bores in said second sleeve, said resettable tumbler lock further comprising a first locking pin disposed movably in said first locking bore, a middle locking pin disposed movably in said middle locking bore, and a second locking pin disposed movably in said second locking bore, said first sleeve and said latch-connecting part being operable to co-rotate relative to said second sleeve so as to permit rotation of said latch-connecting part between locked and unlocked positions, said blind bores in said second sleeve being aligned axially and respectively with said tumbler bores in said first sleeve, the axial projection of each of said blind bores coinciding with that of the respective one of said tumbler bores, and the first, second, and third locking bores being aligned axially when said first sleeve is disposed at said first angular position, said second tumbler pin of each of said tumbler units being in end-to-end contact with said middle tumbler pin of the respective one of said tumbler units so as to define a second interface therebetween, said second locking pin being in end-to-end contact with said middle locking pin so as to define a locking interface therebetween, said locking interface being disposed within said second locking bore when said tumbler units are moved to said second axial position, thereby preventing rotation of said latch-connecting part relative to said second sleeve, said tumbler units being further operable to move axially from said first axial position to a third axial position, in which said second interfaces and said locking interface lie on said locking plane, thereby permitting co-rotation of said first sleeve and said latch-connecting part relative to said second sleeve.

5. The resettable tumbler lock of claim 4, further comprising a plurality of first urging members that are respectively disposed in said blind holes in said latch-connecting part for urging said tumbler pads, a plurality of second urging members that are respectively disposed in said blind bores in said second sleeve for urging said second tumbler pins, and a third urging member that is disposed in said second locking bore for urging said second locking pin.

6. The resettable tumbler lock of claim 4, wherein each of said first and second tumbler pins, said middle tumbler pins, and said tumbler pads has a cross-section conforming to the shape of said tumbler bores in said first sleeve.

7. A resettable tumbler lock comprising:

a lock housing;

a first sleeve mounted coaxially and rotatably in said lock housing and formed with a plurality of tumbler bores, each having a longitudinal axis and having a non-circular cross-section perpendicular to said longitudinal axis of the given tumbler bore;

a cylindrical latch-connecting part mounted coaxially and rotatably in said lock housing and in end-to-end contact with said first sleeve, said latch-connecting part being formed with a plurality of circumferentially disposed tumbler holes, each having a longitudinal axis and having a non-circular cross-section perpendicular to said longitudinal axis of the given tumbler hole, and a plurality of circumferentially disposed blind holes that are angularly displaced with said tumbler holes, each having a longitudinal axis and having a circular cross-section perpendicular to said longitudinal axis of the given blind hole; and a plurality of spring-biased tumbler units, each of which is disposed movably in a respective one of said tumbler bores, a respective one of said tumbler holes, and a respective one of said blind holes; wherein said first sleeve is operable to rotate relative to said latch-connecting part between a first angular position, in which said tumbler bores in said first sleeve are aligned axially and respectively with said tumbler holes in said latch-connecting part, and a second angular position, in which said tumbler bores in said first sleeve are aligned axially and respectively with said blind holes in said latch-connecting part;

wherein each of said tumbler bores in said first sleeve has an axial projection that coincides with that of the axially aligned one of said tumbler holes in said latch-connecting part when said first sleeve is disposed at said first angular position, and that coincides with that of the axially aligned one of said blind holes in said latch-connecting part when said first sleeve is disposed at said second angular position;

wherein at least one of said tumbler bores in said first sleeve is aligned axially with one of said tumbler holes in said latch-connecting part when said first sleeve is rotated relative to said latch-connecting part to a predetermined position between said first and second angular positions; and wherein the axial projection of said one of said tumbler bores in said first sleeve does not coincide with that of the aligned one of said tumbler holes in said latch-connecting part when said first sleeve is disposed at the predetermined position between said first and second angular positions so as to prevent deadlock from occurring on said resettable tumbler lock.

8. The resettable tumbler lock of claim 7, wherein each of said tumbler bores has symmetrical portions and defines a symmetric axis, and said symmetric axes of said tumbler bores differ from each other in orientation.

9. The resettable tumbler lock of claim 8, wherein said first sleeve and said latch-connecting part have an interface and cooperatively define a resetting plane at the interface therebetween, each of said tumbler units including a first tumbler pin disposed movably in a respective one of said tumbler bores in said first sleeve, a middle tumbler pin disposed movably in a respective one of said tumbler holes in said latch-connecting part, and a plurality of tumbler pads disposed movably and selectively in said blind holes and said tumbler bores such that at least one of said tumbler bores receives at least one of said tumbler pads of the respective one of said tumbler units therein, said at least one of said tumbler pads in said at least one of said tumbler bores being in end-to-end contact with said middle tumbler pin in the respective one of said tumbler holes so as to define a first interface therebetween, said first tumbler pin in each of the remainder of said first tumbler bores being in end-to-end contact with said middle tumbler pin in the respective one of the remainder of said tumbler holes so as to define another first interface therebetween, said tumbler units being operable to move axially from a first axial position, in which at least one of said first interfaces is axially spaced apart from said resetting plane, to a second axial position, in which said first interfaces lie on said resetting plane, thereby permitting rotation of said first sleeve relative to said latch-connecting part.

10. The resettable tumbler lock of claim 9, further comprising a second sleeve that is disposed opposite to said first sleeve and that is in end-to-end contact with said latch-connecting part so as to define a locking plane at an interface therebetween, said first sleeve being further formed with a first locking bore, said latch-connecting part being further formed with a middle locking bore, said second sleeve being formed with a plurality of circumferentially disposed blind bores and a second locking bore, each of said tumbler units further including a second tumbler pin disposed movably in a respective one of said blind bores in said second sleeve, said resettable tumbler lock further comprising a first locking pin disposed movably in said first locking bore, a middle locking pin disposed movably in said middle locking bore, and a second locking pin disposed movably in said second locking bore, said first sleeve and said latch-connecting part being operable to co-rotate relative to said second sleeve so as to permit rotation of said latch-connecting part between locked and unlocked positions, said blind bores in said second sleeve being aligned axially and respectively with said tumbler bores in said first sleeve, the axial projection of each of said blind bores coinciding with that of the respective one of said tumbler bores, and the first, second, and third locking bores being aligned axially when said first sleeve is disposed at said first angular position, said second tumbler pin of each of said tumbler units being in end-to-end contact with said middle tumbler pin of the respective one of said tumbler units so as to define a second interface therebetween, said second locking pin being in end-to-end contact with said middle locking pin so as to define a locking interface therebetween, said locking interface being disposed within said second locking bore when said tumbler units are moved to said second axial position, thereby preventing rotation of said latch-connecting part relative to said second sleeve, said tumbler units being further operable to move axially from said first axial position to a third axial position, in which said second interfaces and said locking interface lie on said locking plane, thereby permitting co-rotation of said first sleeve and said latch-connecting part relative to said second sleeve.

11. The resettable tumbler lock of claim 10, further comprising a plurality of first urging members that are respectively disposed in said blind holes in said latch-connecting part for urging said tumbler pads, a plurality of second urging members that are respectively disposed in said blind bores in said second sleeve for urging said second tumbler pins, and a third urging member that is disposed in said second locking bore for urging said second locking pin.

12. The resettable tumbler lock of claim 10, wherein each of said first and second tumbler pins, said middle tumbler pins, and said tumbler pads has a cross-section conforming to the shape of said tumbler bores in said first sleeve.

* * * * *